US008157139B2

(12) United States Patent
Keeler

(10) Patent No.: US 8,157,139 B2
(45) Date of Patent: Apr. 17, 2012

(54) BACKPACK AND METHOD FOR SECURING A BACKPACK IN A CLOSED POSITION

(76) Inventor: George Guest Keeler, Wayland, MA (US)

( * ) Notice: Subject to any disclaimer, the term of this patent is extended or adjusted under 35 U.S.C. 154(b) by 557 days.

(21) Appl. No.: 12/277,720

(22) Filed: Nov. 25, 2008

(65) Prior Publication Data

US 2010/0127033 A1 May 27, 2010

(51) Int. Cl.
*A45F 3/04* (2006.01)

(52) U.S. Cl. ..... 224/654; 224/101; 224/652; 224/656

(58) Field of Classification Search ..... 224/654, 224/101, 652, 656
See application file for complete search history.

(56) References Cited

U.S. PATENT DOCUMENTS 2,407,787 A * 9/1946 Kernahan ..... 224/656
4,156,446 A * 5/1979 Nathan ..... 383/6
4,213,549 A * 7/1980 Hibbard ..... 224/601
5,467,907 A * 11/1995 Celik ..... 224/103
5,803,333 A * 9/1998 Fawcett ..... 224/652
5,878,928 A * 3/1999 Seiber ..... 224/153
6,547,110 B2 * 4/2003 O'Hare ..... 224/155
2006/0011676 A1 * 1/2006 Willows et al. ..... 224/148.4
2008/0277433 A1 * 11/2008 Karl et al. ..... 224/148.6

* cited by examiner

*Primary Examiner* — Brian D Nash
(74) *Attorney, Agent, or Firm* — RatnerPrestia

(57) ABSTRACT

A backpack includes a body having a closure portion which defines an opening through which an interior region of the body can be accessed selectively. In the opened position, end portions of the closure portion are extended away from one another, permitting access to the interior region. In the closed position, end portions are moved toward one another, inhibiting access to the interior region. A cord coupled to the strap assembly and to the end portions of the closure portion has a first configuration which permits movement of the closure portion to the open position, and a second configuration which inhibits extension of the end portions of the closure portion away from one another. A method for securing a backpack in a closed position includes positioning the cord in the second configuration, which permits drawing of the closure portion to a closed position.

9 Claims, 12 Drawing Sheets

BACKPACK AND METHOD FOR SECURING A BACKPACK IN A CLOSED POSITION

FIELD OF THE INVENTION

The present invention pertains to backpacks and particularly to closure systems for backpacks.

BACKGROUND OF THE INVENTION

Backpacks have long served many different functions. Over the years, backpacks of various configurations have been used for day-to-day purposes, such as for carrying books or other personal belongings, as well as for recreational or physically strenuous activities. Regardless of its function, it is desirable for a backpack to be strongly secured when in a closed position, so that the contents inside are protected from falling out or from being damaged. This is especially true for backpacks that are worn during outdoor activities, such as hiking, kayaking, or biking, as the backpack can be prone to getting wet or being knocked around. For backpacks that are worn during recreational activities, it is also desirable for a user to be able to open and close the bag quickly and efficiently, so that the contents of the bag can be easily accessed with minimal interruptions. Accordingly, it is desirable to provide versatile backpacks which can be easily opened and closed, and which can be secured when in a closed position.

SUMMARY OF THE INVENTION

According to an exemplary embodiment, the present invention provides a backpack. The backpack includes a strap assembly for mounting the backpack to a user. A body of the backpack is coupled to the strap assembly and has a closure portion defining an opening through which an interior region of the body can be accessed selectively. The closure portion has an opened position and a closed position. In the opened position, the end portions of the closure portion are extended away from one another, thus permitting access to the interior region of the body through the opening. In the closed position, the end portions of the closure portion are moved toward one another, thus inhibiting access to the interior region of the body through the opening. A cord is coupled to the strap assembly and to the end portions of the closure portion. The cord has a first configuration that permits extension of the end portions of the closure portion away from one another and movement of the closure portion to the open position. The cord also has a second configuration that inhibits extension of the end portions of the closure portion away from one another and maintains the closure in the closed position.

A further exemplary embodiment of the present invention provides a method for securing a backpack in a closed position. The method includes positioning a closure portion in an open position in which opposite end portions of the closure portion are extended away from each other. In the open position, a cord coupled to the opposite end portions of the closure portion is in a first configuration permitting extension of the closure portion to the open position. The method also includes positioning the cord in a second configuration, which permits drawing of the closure portion to a closed position in which the opposite end portions of the closure portion are drawn toward each other, thereby inhibiting access to an interior region of the backpack.

BRIEF DESCRIPTION OF THE DRAWINGS

The invention is best understood from the following detailed description when read in connection with the accompanying drawings. It is emphasized that, according to common practice, the various features of the drawings may not be to scale. Included in the drawings are the following figures.

DETAILED DESCRIPTION OF THE INVENTION

Although the invention is illustrated and described herein with reference to specific embodiments and variations thereof, the invention is not intended to be limited to the details shown. Rather, various modifications may be made in the details within the scope and range of equivalents of the claims and without departing from the invention.

Figure 1:
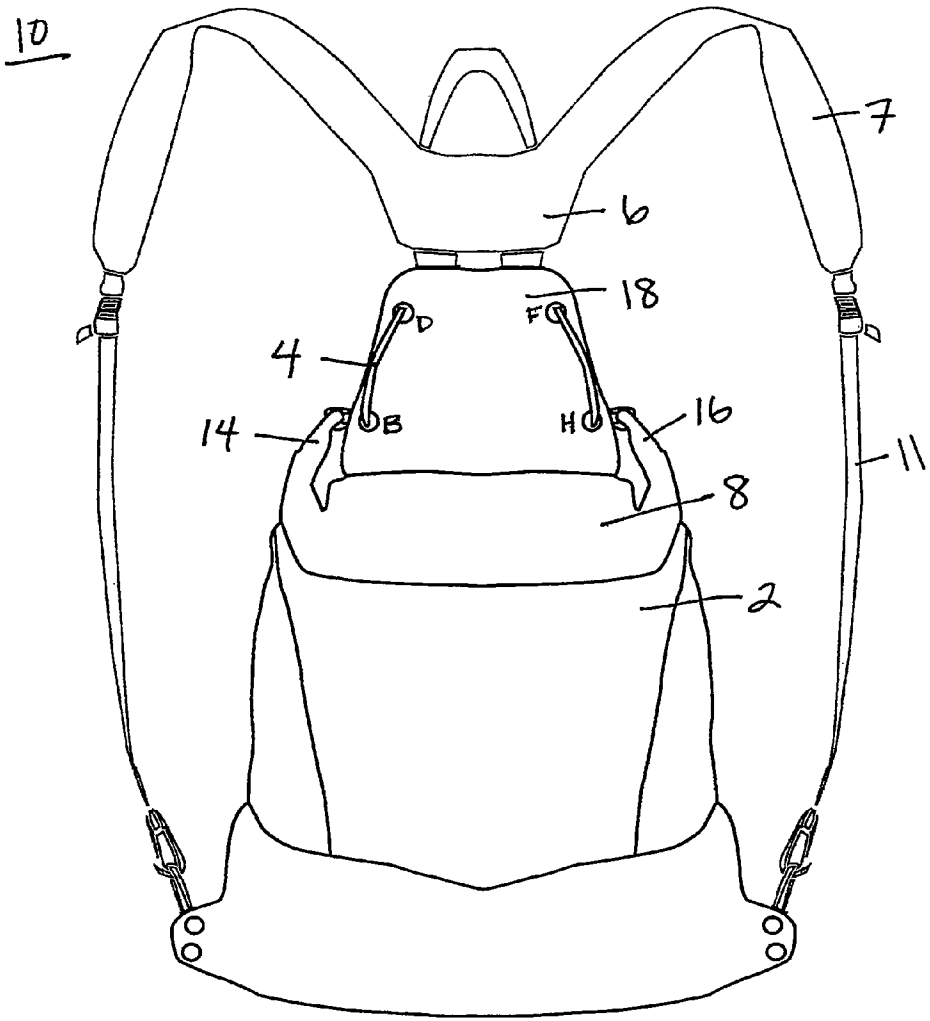
FIG. 1 is a front view of an embodiment of the backpack with a closure portion in a closed position.
Figure 2:
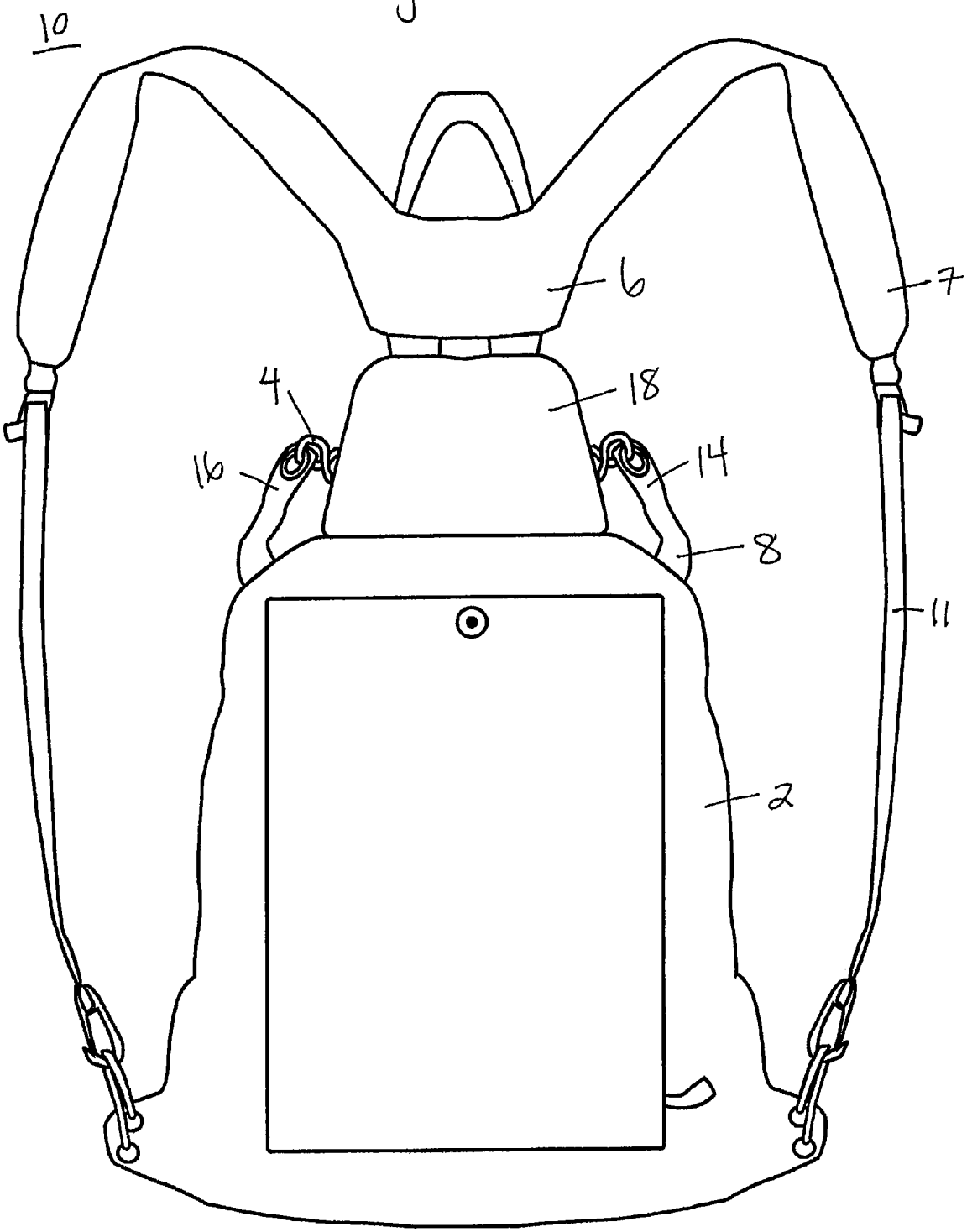
FIG. 2 is a rear view of the backpack illustrated in FIG. 1.

Referring to the figures, FIGS. 1 and 2 illustrate a backpack 10 according to one exemplary embodiment of the present invention, in which the backpack is in a closed position. The backpack 10 generally comprises a body 2 coupled to a strap assembly 6. The strap assembly 6 has an anchor portion 18. The body 2 of the backpack 10 has a closure portion 8. The closure portion 8 defines an opening 12 (FIG. 3) through which an interior region of the body 2 can be accessed selectively. A cord 4 is coupled to the strap assembly 6 and to end portions 14, 16 of the closure portion 8. The strap assembly 6 is used for mounting the backpack 10 to a user. For example, shoulder straps 7 can be mounted onto a person's shoulders and drawstring straps 11 that are integral with or coupled to the shoulder straps 7 can be used to adjust the shoulder straps 7. In FIG. 1, although the cord 4 is shown extending directly between cord-support surfaces D, B and F, H of the anchor portion 18, in an exemplary embodiment, the cord 4 extends to cord-support surfaces C (between D and B) and G (between F and H) located at the end portions 14, 16 of the closure portion 8 instead of directly between cord-support surfaces D, B and F, H of the anchor portion 18, as shown, for example, in FIG. 3.

The features of the backpack 10 described herein can be constructed from any suitable material. In an exemplary embodiment, the body 2 of the backpack 10 is constructed from a flexible and waterproof material, such as nylon fabric. The body 2 of the bag may also be constructed from canvas or bamboo fabric. The shoulder straps 7 may be constructed from a nylon fabric that is the same as the body 2 material, but may also be formed from a different material. In an exemplary embodiment, the shoulder straps 7 are constructed from flat seatbelt webbing with a cord-like material woven into a macramé stitch, and drawstring straps 11 are constructed from approximately ½ inch width flat nylon webbing. The cord 4 may be constructed from any suitable material. In an exemplary embodiment, the cord 4 is constructed from a material that permits the cord 4 to bend around corners, such as a nylon material that has a width of approximately 2 mm to 3 mm. For example, the cord 4 is optionally parachute cord (or paracord). Other flexible materials are contemplated as well, including plastic and non-plastic materials.

Figure 3:
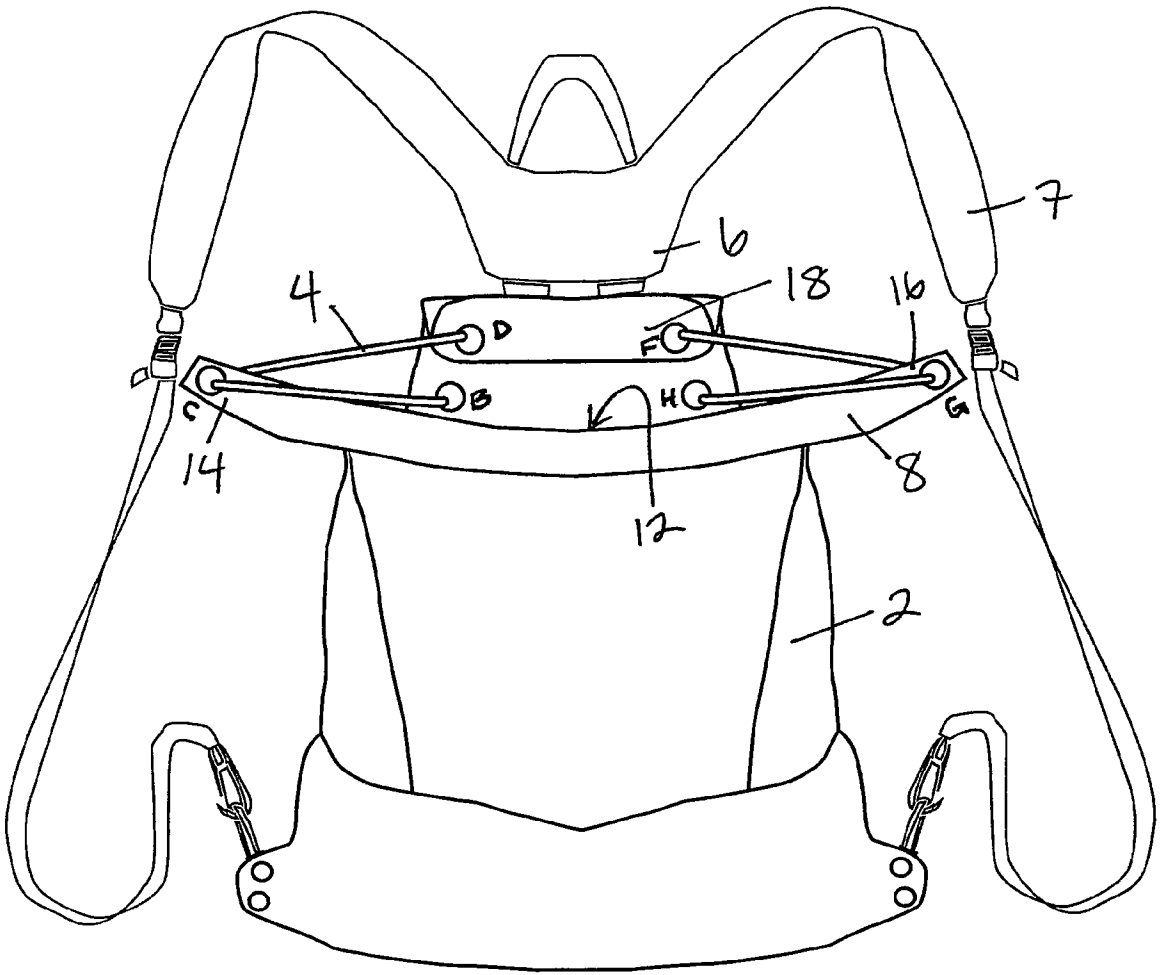
FIG. 3 is a front view of an embodiment of the backpack with a closure portion in an opened position.

FIG. 3 illustrates a backpack 10 according to an embodiment of the present invention, in which the closure portion 8 is in an opened position. In an exemplary embodiment of the opened position, the end portions 14, 16 of the closure portion 8 are extended away from one another and the closure portion 8 is unrolled. This permits a user to access the interior region of the body 2 through the opening 12 defined by the closure portion 8. In the opened position, the cord 4 has a first configuration which permits extension of the end portions 14, 16 of the closure portion 8 away from one another and movement of the closure portion 8 to the opened position. The closure portion 8 is preferably a roll top that comprises two nylon webbing pieces attached to the opening 12 at the top of the body 2. The optional webbing pieces of the closure portion 8 define the two edges of the opening 12 of the backpack 10 and provide a relatively stiff edge that can be easily rolled.

FIG. 1 shows the closure portion 8 in a closed position. In an exemplary embodiment of a closed position, the closure portion 8 is rolled and the end portions 14, 16 of the closure portion 8 are moved toward one another. This inhibits access to the interior region of the body 2 through the opening 12. In the closed position, the cord 4 is in a second configuration which inhibits extension of the end portions 14, 16 away from one another and maintains the closure portion 8 in the closed position. The closure portion 8 also has an intermediate position in which the closure portion 8 is rolled with the end portions 14, 16 of the closure portion 8 still extended away from each other, thereby inhibiting access to the interior region of the body 2 through the opening 12.

Figure 4:
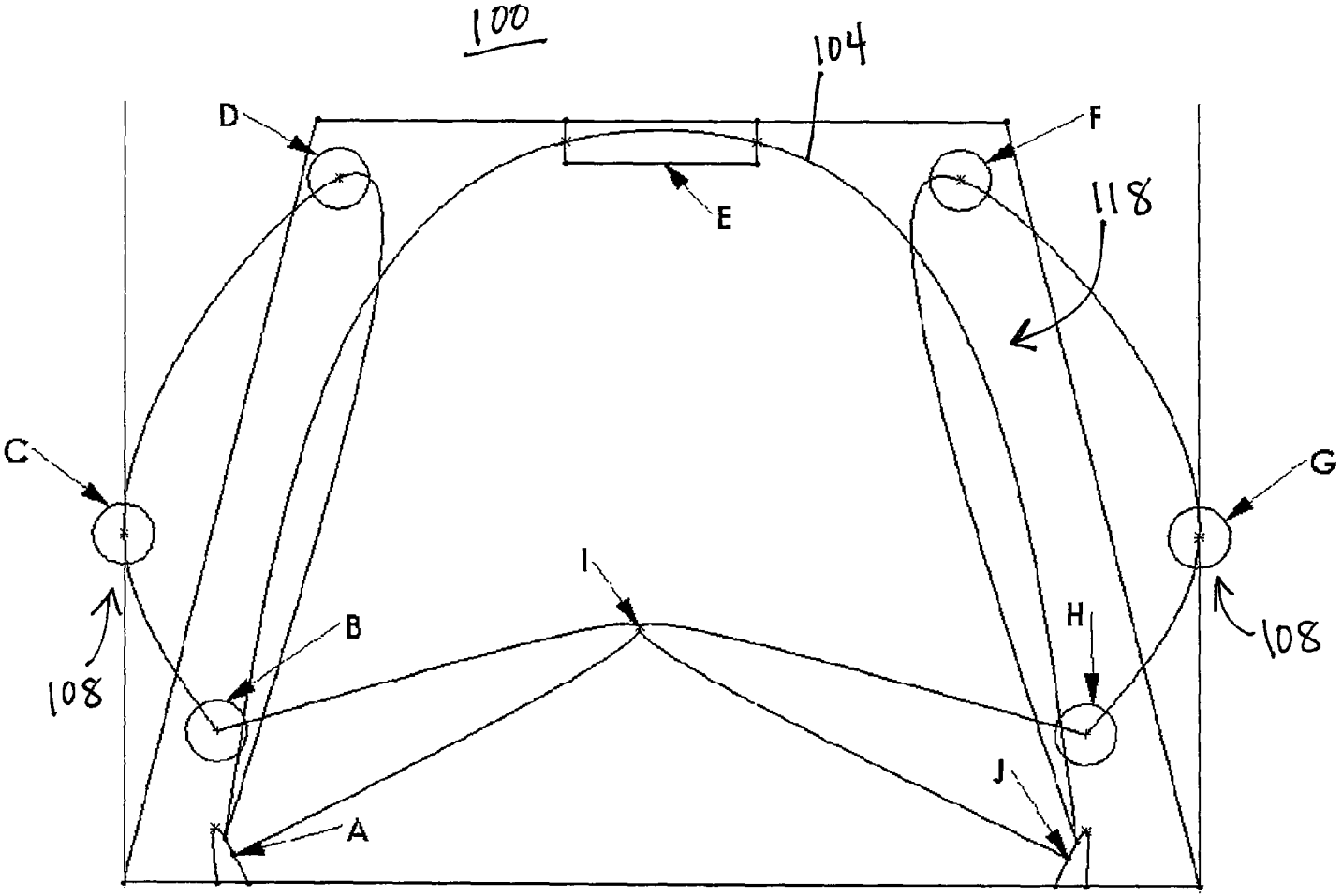
FIG. 4 is a schematic view of an embodiment of the stringing configuration of the closure system.

Referring to FIG. 4, an exemplary embodiment of a closure system for the backpack is based on a stringing configuration 100 that uses a cord 104. This system allows the backpack to close securely under the weight of the backpack itself, without the need to fasten an additional closure device, thereby eliminating the requirement of using additional hardware such as a strap or buckle (though the use of a strap or buckle or other hardware is also contemplated). FIG. 4 shows a schematic view of an exemplary embodiment of the stringing configuration 100, in which Points B, D, F, and H are disposed within the anchor portion 118, and Points C and G are disposed at the end portions of the closure portion 108. Points B, D, F, and H are arranged at apices of a four-sided geometry in this embodiment, and are movable with respect to one another from relatively near positions to relatively far positions as the backpack is moved from the opened position to the closed position. As will be described later in greater detail, the points B, D, F, and H are movable with respect to one another because they are optionally fixed or otherwise mounted to a flexible material that can be stretched and/or collapsed.

Figure 5:
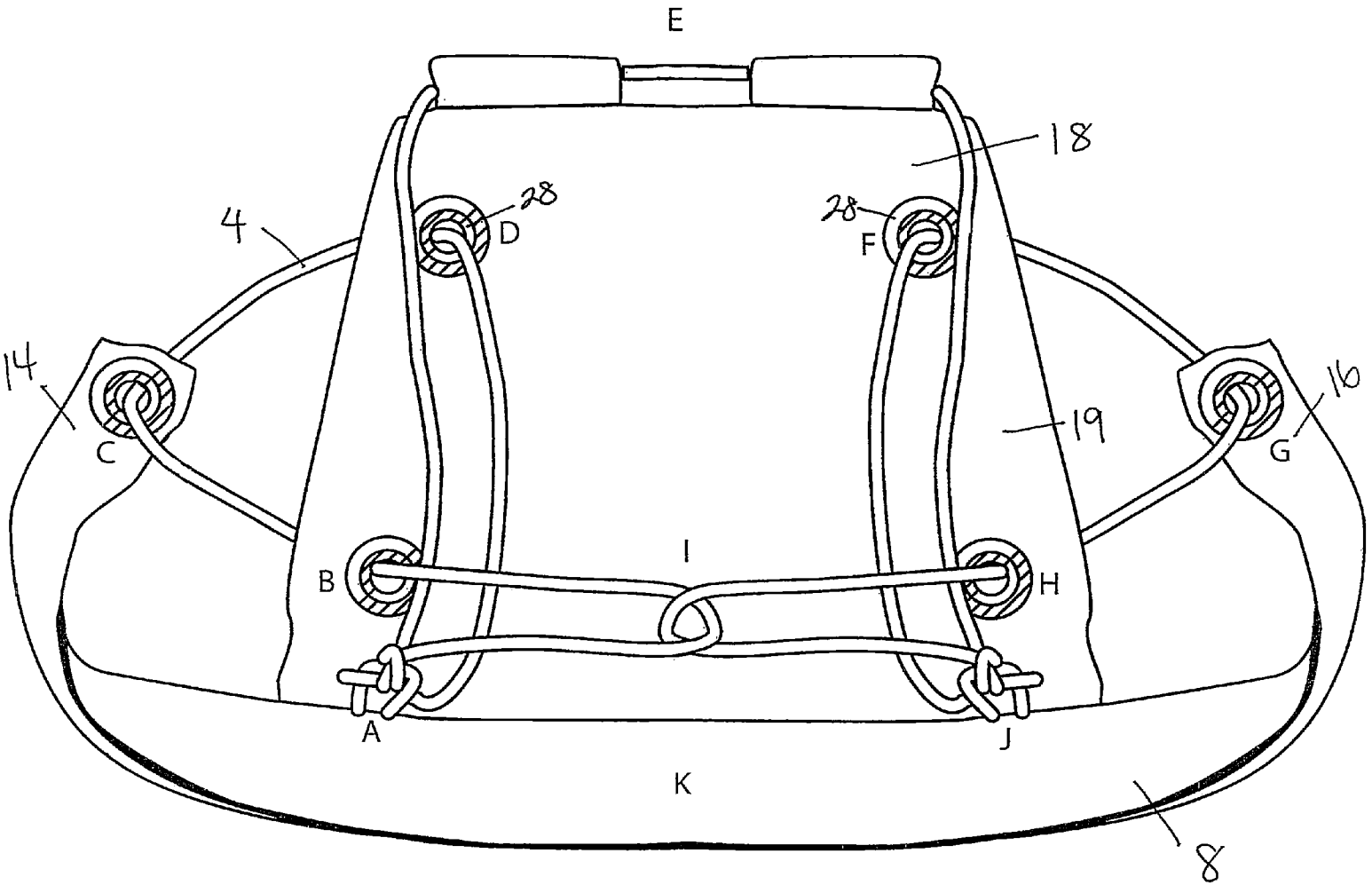
FIG. 5 is a front view of an embodiment of the closure system in a closed position.
Figure 6:
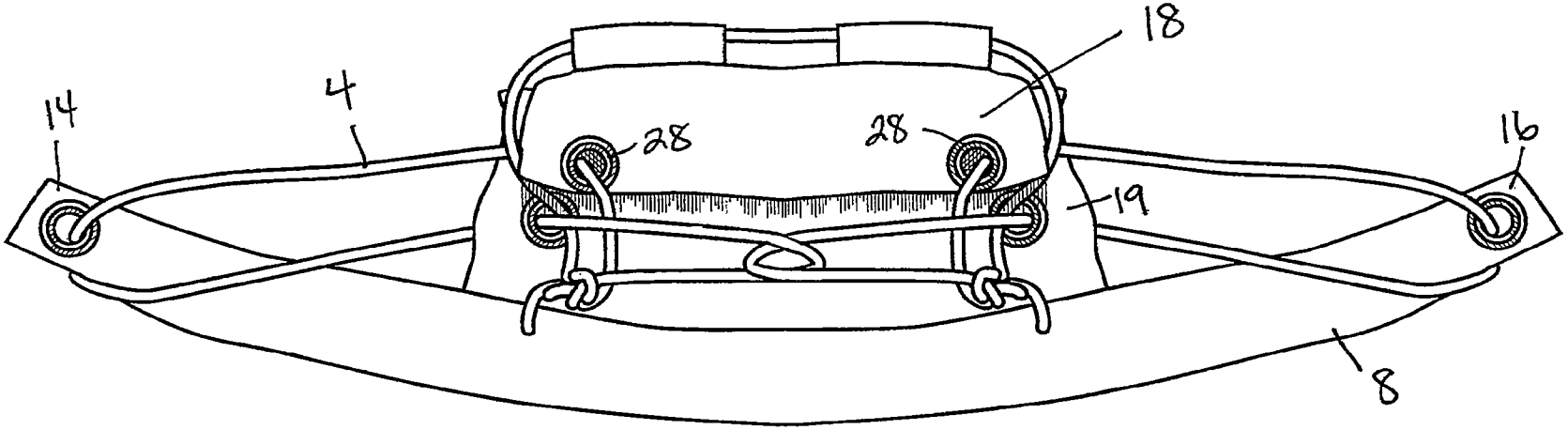
FIG. 6 is a front view of an embodiment of the closure system in an opened position.
Figure 7:
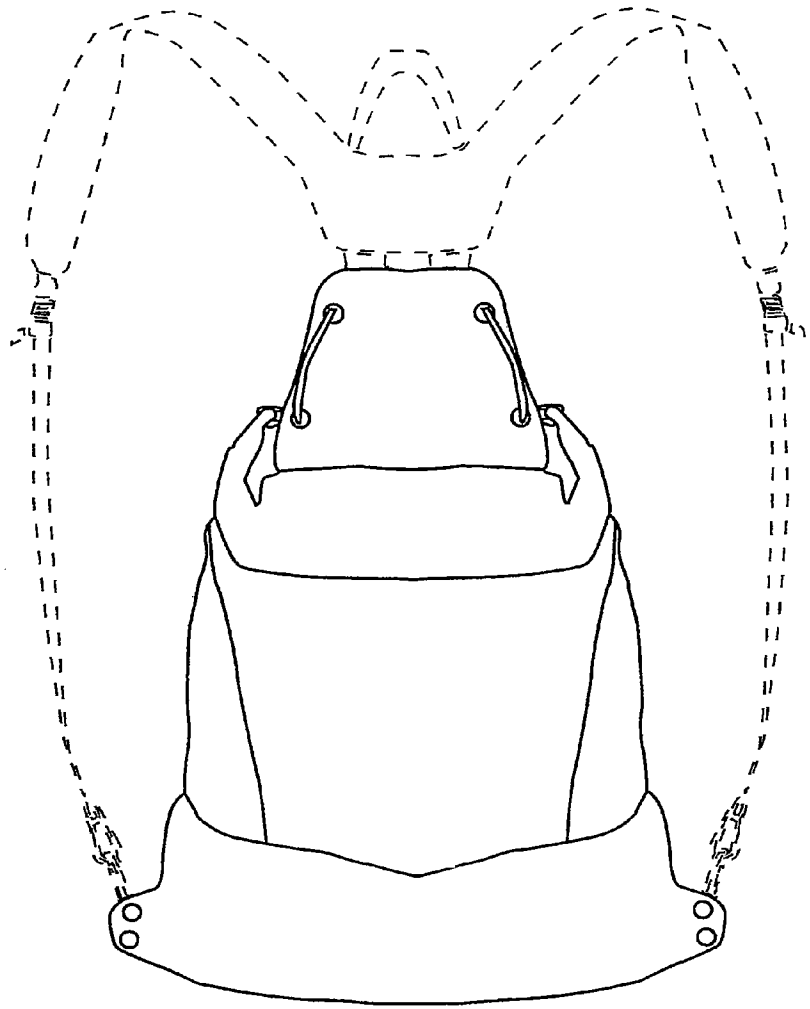
FIG. 7 is a front view of an embodiment of the backpack with the closure portion in a closed position in accordance with ornamental aspects of the backpack.
Figure 8:
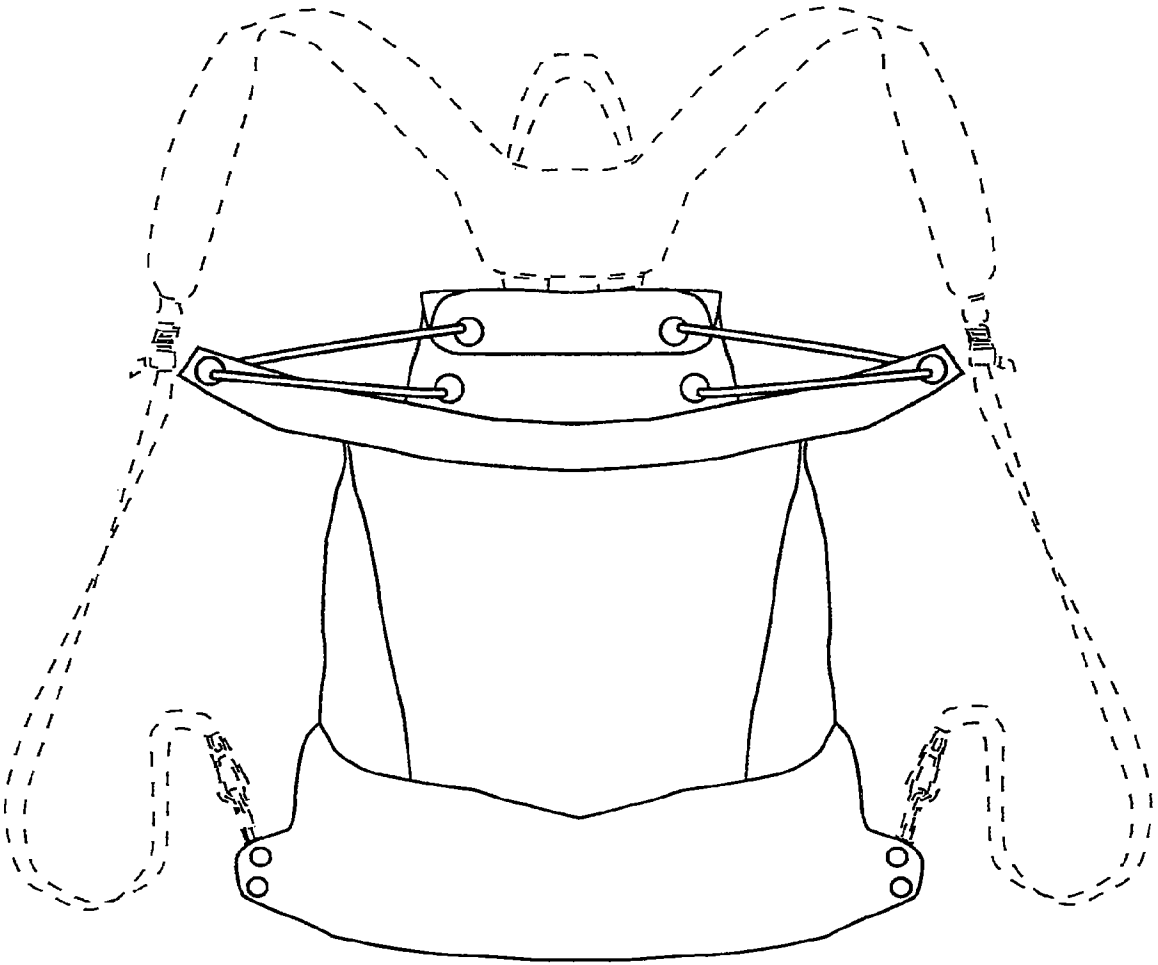
FIG. 8 is a front view of an embodiment of the backpack with the closure portion in an opened position in accordance with ornamental aspects of the backpack.
Figure 9:
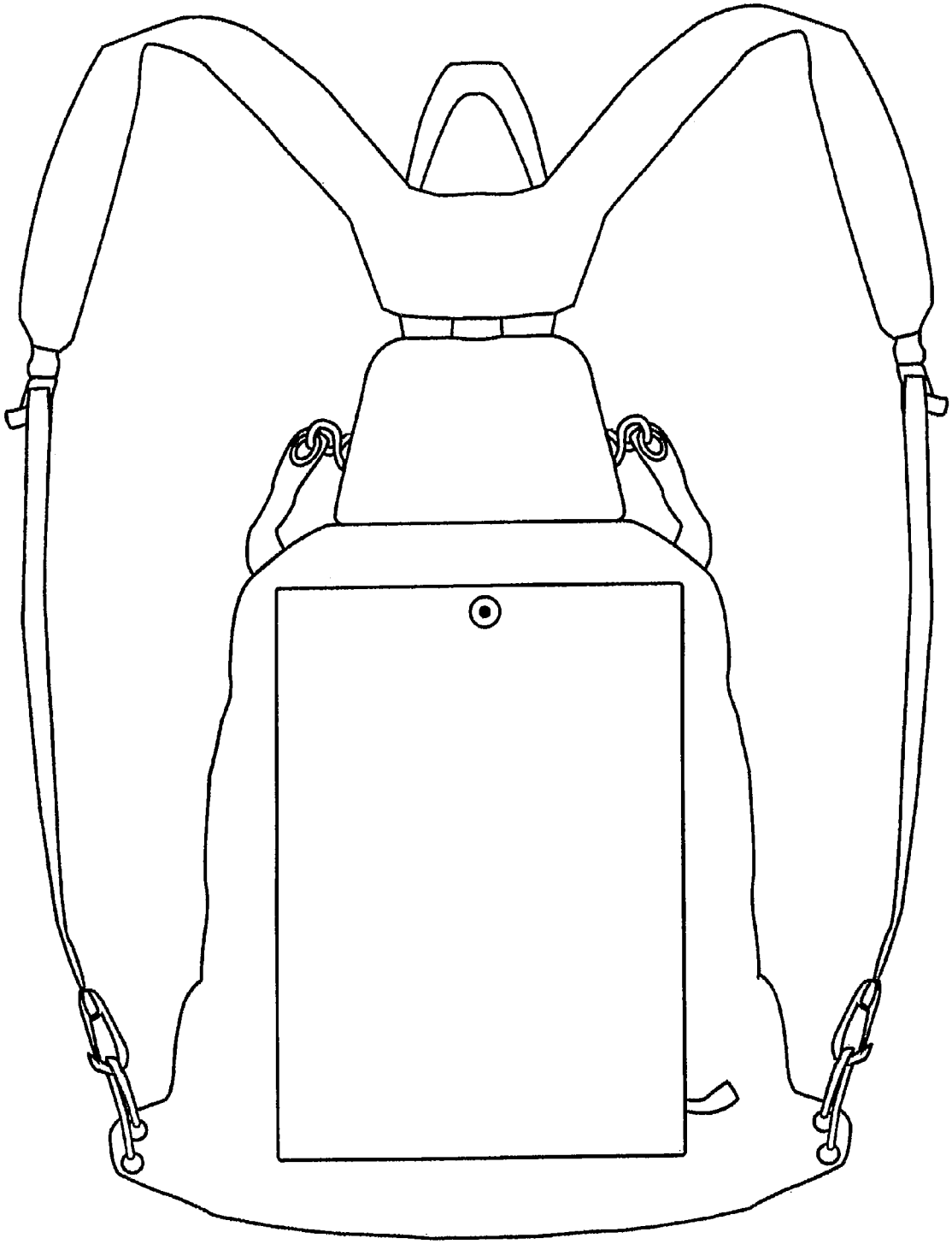
FIG. 9 is a rear view of the backpack illustrated in FIG. 7 in accordance with ornamental aspects of the backpack.
Figure 10:
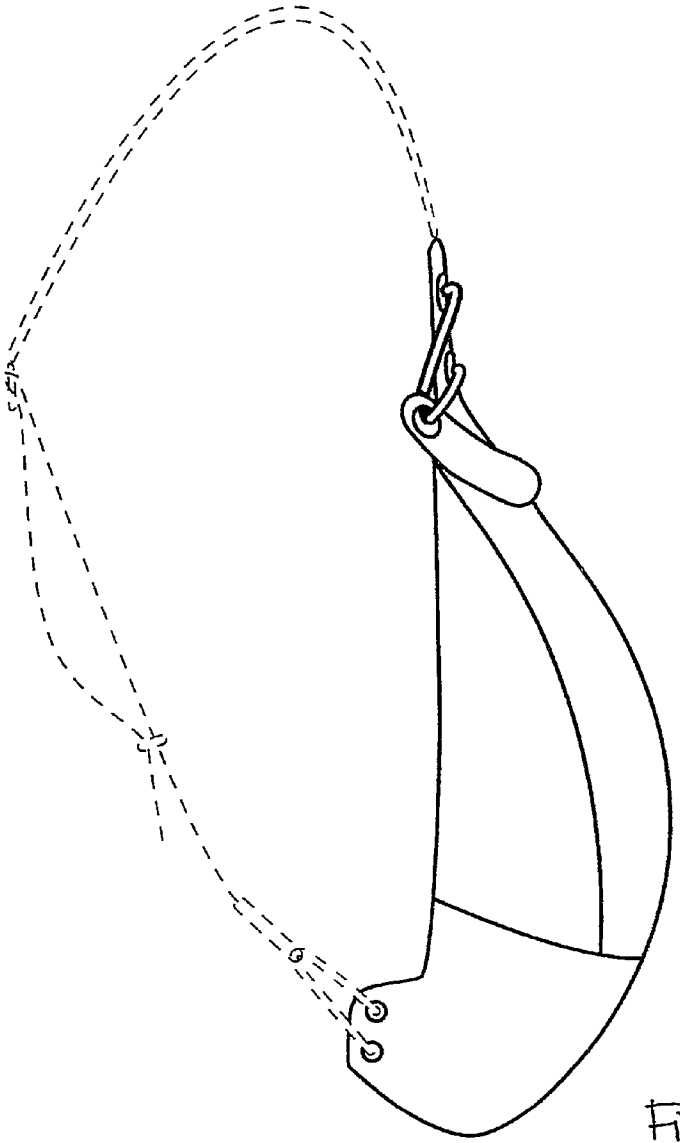
FIG. 10 is a side view of the backpack illustrated in FIG. 7, as viewed from the right side of FIG. 7 in accordance with ornamental aspects of the backpack, the other side being a mirror image thereof.
Figure 11:
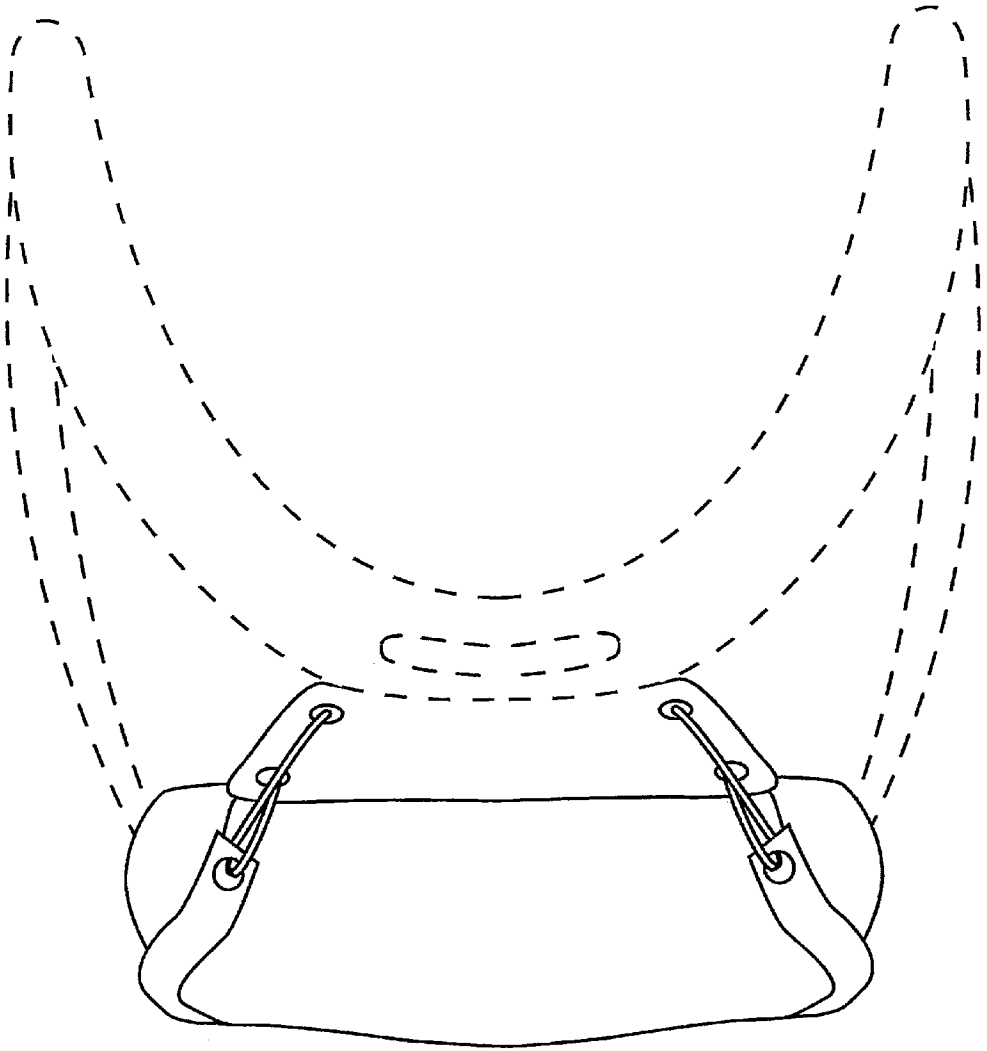
FIG. 11 is a top view of the backpack illustrated in FIG. 7 in accordance with ornamental aspects of the backpack.
Figure 12:
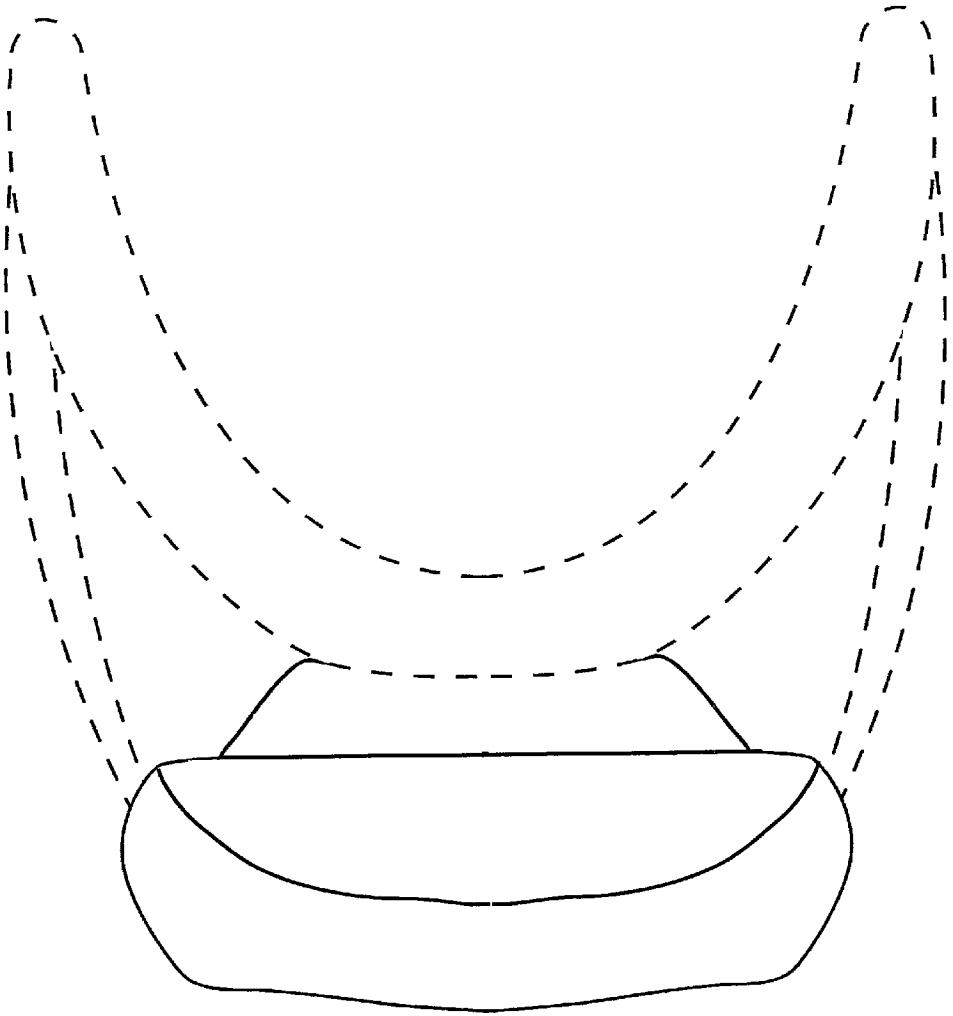
FIG. 12 is a bottom view of the backpack illustrated in FIG. 7 in accordance with ornamental aspects of the backpack.

FIGS. 5 and 6 show the anchor portion 18 of the strap assembly with the closure portion 8 in a closed position and an opened position, respectively. In these views, an exterior layer of the anchor portion 18 has been removed to reveal details of the closure system. In an exemplary embodiment, the anchor portion 18 at least partially encloses the stringing configuration 100 inside a pouch such as that formed by a nylon zippered pocket 19 that is flexible to allow for the top of the anchor portion 18 to move toward and away from the bottom of the anchor portion 18, thus providing proper opening and closing of the backpack 10. The pocket 19 is optionally constructed from two pieces of nylon fabric sewn together with an opening such as a zipper opening at the bottom and attached to the body 4 of the backpack 10. A top portion of the pocket 19 is directly or indirectly secured to the strap assembly 6. In an exemplary embodiment, portions of the backpack 10 are stitched together by a durable nylon thread. For example, the strap assembly 6 is optionally double-stitched to two pieces of nylon webbing and then stitched to the anchor portion 18 for higher durability. The shoulder straps 7 and closure portion 8 are also optionally double-stitched to ensure durability.

As shown in FIGS. 5 and 6, the anchor portion 18 has cord-support surfaces B, D, F, and H, and the closure portion 8 has cord-support surfaces C and G. The cord 4 is positioned to slide with respect to the cord-support surfaces. In an exemplary embodiment, each cord-support surface of the anchor portion 18 and closure portion 8 at least partially defines an aperture formed in the anchor portion 18 and closure portion 8, respectively. The apertures are defined by grommets 28, such as metallic grommets, mounted to the anchor portion 18 and closure portion 8 in one embodiment. For example, the grommets 28 can be riveted to the anchor portion 18 and closure portion 8. In one exemplary embodiment, the apertures are defined by aluminum grommets that are attached to the anchor portion 18 and closure portion 8 by using tools that apply friction and pressure to keep the grommets securely attached to nylon.

The cord-support surfaces and related Points A-H shown in FIGS. 5 and 6 correspond generally to Points A-H, respectively, shown in the schematic illustration of FIG. 4. For example, Points A and J correspond to lower anchors, Point E corresponds to an upper anchor, Points D and F correspond to upper cord-support surfaces of the anchor portion 18, Points B and H correspond to lower cord-support surfaces of the anchor portion 18, and Points C and G correspond to cord-support surfaces of the closure portion 8. The anchor portion 18 is movable from a collapsed position to an expanded position as the closure portion 8 is moved from an opened position to a closed position and as the cord 4 is moved from the first configuration to the second configuration. Because the anchor portion 18 is preferably formed from flexible or collapsible material, the distance between cord-support portions D and F near the top of anchor portion 18 and cord-support portions B and H near the bottom of anchor portion 18 can be changed from the expanded position shown in FIG. 5 and the collapsed position shown in FIG. 6. In this way, slack in the cord 4 is formed in the portion of cord 4 that extends to cord-support portions C and G, thus permitting movement of the closure portion 8 from the closed position (FIG. 5) to the open position (FIG. 6).

The cord 4 is relatively more taut, in the locations where it extends outwardly from the anchor portion 18 between the cord-support portions D and F and the cord-support portions B and H, when the anchor portion 18 is in the expanded position than when it is in the collapsed position. Again, this permits movement of the closure portion 8 from the closed position (FIG. 5) to the open position (FIG. 6).

With reference to the stringing configuration 100 shown schematically in FIG. 4, the cord 104 is coupled to point A. For example, the cord 104 can be coupled to point A by creating a knot, such as a double knot, in the cord 104 around point A. The cord 104 can alternatively be sewn or otherwise attached directly or indirectly to point A, though a knot may provide more adjustability. From Point A, the cord 104 extends to Point B. From Point B, the cord 104 extends to Point C and from Point C to Point D. From Point D, the cord 104 extends back to Point A. From Point A, the cord extends to point E and from Point E to Point J. In an exemplary embodiment, Points J, H, G, and F are mirror images of Points A, B, C, and D, respectively.

The cord extends between Points J, H, G, and F in the same manner and in the same order as it extends through Points A, B, C, and D, as described above. Thus, from Point J the cord extends to Point F, from Point F to Point G, and from Point G to Point H. From Point H, the cord returns to Point J, to which it is coupled. The portions of the cord 104 that extend between Point A and Point B and between Point J and Point H can loop around each other at Point I, in order to provide extra slack to the cord 104.

To open the backpack, a user pulls Points C and G away from each other. The cord 104 is pulled through Points D and F, which causes Points D and F to move toward Points B and H, respectively. As Points D and F and Points B and H move toward each other, slack is created in the cord 104. To close the backpack, a user creates tension in Point E, such as by pulling up on the backpack or by allowing the weight of the contents of the backpack to pull downwardly against the strap assembly. The tension in Point E causes the cord 104 to be pulled through Points D and F, and Points D and F move away from Points B and H, respectively. This causes Points C and G to be drawn toward each other, thereby positioning the backpack in a closed position.

With reference to FIGS. 5 and 6, the cord 4 is positioned to slide with respect to a first pair of cord-support surfaces D, B and a second pair of cord-support surfaces F, H. Each pair of cord-support surfaces includes an upper cord-support surface D, F and a lower cord-support surface B, H. The upper cord-support surfaces D, F and lower cord-support surfaces B, H are movable with respect to one another from a relatively near position to a relatively far position as the closure portion 8 is moved from the opened position to the closed position. The cord 4 is also positioned to slide with respect to cord-support surfaces C and G located at the end portions 14, 16 of the closure portion 8. In an exemplary embodiment, the cord 4 is coupled to at least one lower anchor (for example, lower anchors A and J) and disposed through or engaged by at least one upper anchor (for example, upper anchor E). The upper anchor E and lower anchors A, J preferably comprise loops of cord or webbing.

As shown in FIGS. 5 and 6, the cord 4 extends from lower anchor A to cord-support surface B of the anchor portion 18, and from cord-support surface B to cord-support surface C of the closure portion 8. From cord-support surface C, the cord extends to cord-support surface D of the anchor portion, from cord-support surface D to lower anchor A, from lower anchor A to upper anchor E, and from upper anchor E to lower anchor J.

In an exemplary embodiment, cord-support surfaces J, H, G, and F are mirror images of cord-support surfaces A, B, C, and D, respectively. The cord extends between cord-support surfaces J, H, G, and F in the same manner and in the same order as it extends through cord-support surfaces A, B, C, and D, as described above. Thus, the cord 4 extends from lower anchor J to cord-support surface F of the anchor portion, from cord-support surface F to cord-support surface G of the closure portion 8, and from cord-support surface G to cord-support surface H of the anchor portion. From cord-support surface H, the cord extends to lower anchor J, to which it is coupled. The portions of the cord 4 that extend between lower anchor A and cord-support surface B and between lower anchor J and cord-support surface H can loop around each other at Point I, in order to provide extra slack to the cord 4.

The present invention provides a method for securing a backpack 10 in a closed position. The method includes the step of positioning a closure portion 8 in an opened position in which opposite end portions 14, 16 of the closure portion 8 are extended away from each other. In the opened position, the cord 4 is in a first configuration, which permits extension of the closure portion 8 to the opened position. In the first configuration, a proper amount of slack in the cord 4 permits the end portions 14, 16 of the closure portion 8 to be pulled away from each other until the closure portion 8 is taut and straight so that it can be easily rolled and unrolled.

In the opened position, a user can unroll the closure portion 8 of the backpack 10 and access the interior region of the body 2, so that articles can be placed inside the interior region or be taken out. The method also includes the step of positioning the cord 4 in a second configuration. The second configuration permits drawing of the closure portion 8 to a closed position in which the opposite end portions 14, 16 of the closure portion 8 are drawn toward each other, thereby inhibiting access to an interior region of the backpack 10. In an exemplary embodiment, the step of positioning the cord 4 in a second configuration optionally comprises holding a top portion of the backpack 10 and permitting the weight of the backpack 10 to pull the cord 4 into the second configuration. Alternatively, the top of the anchor portion of the backpack 10 can be pulled while holding the body of the backpack steady to pull the cord 4 into the second configuration.

As mentioned above, the closure system of the backpack allows the backpack to close securely under the weight of the backpack itself, and enables a user to open and close the backpack 10 relatively quickly without requiring closure devices, such as straps or buckles, which need to be unfastened and re-fastened, though the optional use of such straps or buckles is contemplated as well. In addition, in embodiments that eliminate closure devices, a user can avoid the problem of closure devices breaking or wearing down, which can cause a backpack to become unsound or unusable.

To open a backpack formed according to exemplary embodiments of the present invention, a user can simply pull the end portions 14, 16 of the closure portion 8 away from each other and unroll the closure portion 8 to access the interior region of the body 2 through the opening 12. From the opened position, a user can roll the closure portion 8 to an intermediate position so that the opening 12 is no longer accessible. From the intermediate position, a user can pull the top of the strap assembly 6 up (or hold the top of the strap assembly 6 and let the weight of the backpack 2 pull the body 2 down) so that the end portions 14, 16 of the closure portion 8 are drawn toward each other and the backpack is securely closed. When the backpack 10 is mounted on a user, the closure portion 8 remains pulled up in the closed position and the contents of the backpack 10 can be prevented from falling out.

FIGS. 7-12 are provided to illustrate ornamental features of the backpack 10. For example, the overall tear drop shape of the body 2 of the backpack 10 when in a closed position is selected for aesthetic purposes. The ornamental appearance of the backpack embodiments illustrated in FIGS. 7-12 can be changed or modified without compromising the functionality and operation of the backpack, and such ornamental features of the three-dimensional configuration of the backpack are motivated by aesthetic considerations as opposed to functional considerations.

While preferred embodiments of the invention have been shown and described herein, it will be understood that such embodiments are provided by way of example only. Numerous variations, changes and substitutions will occur to those skilled in the art without departing from the spirit of the invention. For example, while aspects of the invention have been described in the context of embodiments of a backpack, it is contemplated that features described herein may also be embodied in other carrying devices such as bags, packs, pouches, and other forms of carrying devices. In other words, features of this invention are not limited to use on backpacks. Accordingly, it is intended that the appended claims cover all such variations as fall within the spirit and scope of the invention.

What is claimed:

1. A backpack comprising:

a strap assembly for mounting the backpack to a user, the strap assembly comprising an anchor portion having cord-support surfaces;

a body coupled to the strap assembly, the body having a closure portion defining an opening through which an interior region of the body can be accessed selectively, the closure portion having an opened position with end portions extended away from one another thus permitting access to the interior region of the body through the opening, and the closure portion having a closed position with end portions moved toward one another thus inhibiting access to the interior region of the body through the opening; and a cord coupled to the strap assembly and to the end portions of the closure portion of the body, the cord having a first configuration permitting extension of the end portions of the closure portion away from one another and movement of the closure portion to the opened position, the cord also having a second configuration inhibiting extension of the end portions of the closure portion away from one another and maintaining the closure portion in the closed position, wherein the cord is positioned to slide with respect to two pairs of the cord-support surfaces, each pair of the cord-support surfaces being movable with respect to one another from relatively near positions to relatively far positions as the closure portion is moved from the opened position to the closed position, wherein each pair of cord-support surfaces comprises an upper cord-support surface and a lower cord-support surface, wherein the upper cord-support surfaces and lower cord-support surfaces are movable with respect to one another from relatively near positions to relatively far positions as the closure portion is moved from the opened position to the closed position.

2. The backpack of claim 1, the end portions of the closure portion each having a cord-support surface, wherein the cord is positioned to slide with respect to the cord-support surfaces of the closure portion, each cord-support surface of the closure portion being movable with respect to one another from relatively far positions to relatively near positions as the closure portion is moved from the opened position to the closed position.

3. The backpack of claim 2, wherein the cord is coupled to at least one lower anchor.

4. The backpack of claim 3, wherein the cord is disposed through or engaged by at least one upper anchor.

5. The backpack of claim 4, wherein the cord extends from a first lower anchor to a first lower cord-support surface of the anchor portion, from the first lower cord-support surface of the anchor portion to a first cord-support surface at an end portion of the closure portion, from the first cord-support surface of the end portion of the closure portion to a first upper cord-support surface of the anchor portion, from the first upper cord-support surface of the anchor portion to the first lower anchor, from the first lower anchor to an upper anchor, and from the upper anchor directly or indirectly to a second lower anchor.

6. The backpack of claim 5, wherein the cord extends from the second lower anchor to a second lower cord-support surface of the anchor portion, from the second lower cord-support surface of the anchor portion to a second cord-support portion at an end portion of the closure portion, from the second cord-support surface at an end portion of the closure portion to a second upper cord-support portion of the anchor portion, and from the second upper cord-support portion of the anchor portion to the second lower anchor.

7. The backpack of claim 6, wherein the first and second (i) anchors, (ii) lower cord-support surfaces of the anchor portion, (iii) cord-support surfaces of the closure portion, and (iv) upper cord-support surfaces of the anchor portion are mirror images of each other.

8. The backpack of claim 7, wherein the portions of cord extending from the first lower anchor to the lower cord-support surface of the anchor portion and from the second lower anchor to the second lower cord-support surface of the anchor portion loop around each other.

9. A backpack comprising:

a strap assembly for mounting the backpack to a user, the strap assembly comprising an anchor portion having cord-support surfaces;

a body coupled to the strap assembly, the body having a closure portion defining an opening through which an interior region of the body can be accessed selectively, the closure portion having an opened position with end portions extended away from one another thus permitting access to the interior region of the body through the opening, and the closure portion having a closed position with end portions moved toward one another thus inhibiting access to the interior region of the body through the opening; and a cord coupled to the strap assembly and to the end portions of the closure portion of the body, the cord having a first configuration permitting extension of the end portions of the closure portion away from one another and movement of the closure portion to the opened position, the cord also having a second configuration inhibiting extension of the end portions of the closure portion away from one another and maintaining the closure portion in the closed position, wherein the cord is positioned to slide with respect to two pairs of the cord-support surfaces, each pair of the cord-support surfaces being movable with respect to one another from relatively near positions to relatively far positions as the closure portion is moved from the opened position to the closed position, wherein each pair of cord-support surfaces comprises an upper cord-support surface and a lower cord-support surface, wherein the cord-support surfaces are arranged at apices of a four-sided geometry, wherein the upper cord-support surfaces and lower cord-support surfaces at the apices of the four-sided geometry are movable with respect to one another from relatively near positions to relatively far positions as the closure portion is moved from the opened position to the closed position.

* * * * *